US005541615A

United States Patent [19]

Koide et al.

[11] Patent Number: 5,541,615

[45] Date of Patent: Jul. 30, 1996

[54] 3 BAND COMMUNICATION EQUIPMENT

[75] Inventors: Eiji Koide, Anjo; Yuichi Murakami, Chiryu; Akimasa Yoshida, Anjo; Kiyokazu Ieda, Toyota; Kazuo Sato, Toyota, all of Japan

[73] Assignee: Aisin Seiki Kabushiki Kaisha, Kariya, Japan

[21] Appl. No.: 218,231

[22] Filed: Mar. 28, 1994

Related U.S. Application Data

[63] Continuation-in-part of Ser. No. 921,590, Jul. 30, 1992, abandoned.

[30] Foreign Application Priority Data

Jul. 31, 1991 [JP] Japan ..... 3-192125

[51] Int. Cl.[6] ..... H01Q 1/10; H01Q 5/00

[52] U.S. Cl. ..... 343/858; 343/715; 343/901

[58] Field of Search ..... 343/715, 901, 343/903, 858, 749, 863; H01Q 1/32, 5/00, 5/01, 1/10

[56] References Cited

U.S. PATENT DOCUMENTS

| | | | |
|---|---|---|---|
| 4,675,687 | 6/1987 | Elliott | 343/903 |
| 4,968,991 | 11/1990 | Yamazaki | 343/901 |
| 5,072,230 | 12/1991 | Taniyoshi et al. | 343/903 |
| 5,089,829 | 2/1992 | Haruyama et al. | 343/903 |
| 5,164,739 | 11/1992 | Koide et al. | 343/715 |

FOREIGN PATENT DOCUMENTS 60-46601 of 1985 Japan .

*Primary Examiner*—Michael C. Wimer

*Attorney, Agent, or Firm*—Sughrue, Mion, Zinn, Macpeak & Seas

[57] ABSTRACT

A three band antenna unit for reception of radio waves in the AM and FM bands and for reception and transmission of radio waves in the UHF band as well as its connection with filters and a communication equipment are disclosed. The antenna unit includes an upper, first element for reception and transmission of a radio wave in the UHF band and a lower, second element for reception of radio waves in the FM band, both connected to a mobile telephone. An AM band signal from the first element is transmitted to the lower, second element through an AM band pass filter. A radio wave signal from the lower, second element is transmitted to an AM/FM tuner through an AM/FM band pass filter. AM band radio wave signal received by the upper, first element which is used for reception and transmission of a radio wave in the UHF band is synthesized with the AM band radio wave signal received by the lower, second element which is used for reception of radio wave in the FM band before it is transmitted to the AM/FM tuner, which therefore exhibits a high AM band reception sensitivity.

5 Claims, 2 Drawing Sheets

3 BAND COMMUNICATION EQUIPMENT

This is a continuation of application Ser. No. 07/921,590 filed Jul. 30, 1992, now abandoned.

FIELD OF THE INVENTION

The invention relates to 3 band communication equipment for reception of radio waves of AM and FM bands and for reception and transmission of UHF band radio wave.

BACKGROUND OF THE INVENTION

Where individual antennas are provided for reception of radio broadcasting waves in the AM and FM bands and for reception and transmission of commercial radio telephone wave and/or personal communication wave in the UHF band, the resulting increased number of antennas requires an extended space for their installation. Accordingly, it is desirable that these antennas be integrated into a substantially single antenna unit. Japanese laid-Open Patent Application No. 46,601/1985 discloses a substantially integrated 3 band antenna in which an upper, first element for reception of radio wave in the UHF band and a lower, second element for reception of radio waves in the AM and FM bands are coaxially disposed and integrally constructed. The second element is used in common for the reception of radio waves in the AM and FM bands, but it will be recognized that ideally, the length of the second element be one-quarter the wavelength $\lambda_f$ of the radio wave of the FM band for reception thereof. If the length of the second antenna is chosen equal to $\lambda_f/4$, there results a degraded reception sensitivity for radio waves in the AM band inasmuch as wavelengths of radio waves in the AM band are generally by two orders of magnitudes greater than the wavelength of radio wave in the FM band. Accordingly, where an AM receiver which is adapted for use with a devoted AM band reception antenna is used, it must be additionally provided with an amplifier.

SUMMARY OF THE INVENTION

It is an object of the invention to enhance the reception sensitivity of radio waves in the AM band for a communication equipment which utilizes a 3 band antenna.

A 3 band communication equipment according to the invention comprises a 3 band antenna (1 to 4) including an upper, first element (1) for reception and transmission of a radio wave in the UHF band and a lower, second element (2) for reception of a radio wave in the FM band, both of which are disposed coaxially, a UHF band receiver/transmitter (7) connected to the upper, first element (1), a filter (5) connected to the upper, first element (1) for deriving an AM band radio wave signal, means (13, 14) for synthesizing the AM band radio wave signal derived by the filter (5) with a radio wave signal from the second element (2), and an AM/FM band wave receiver (9) connected to the means (13, 14). It is to be understood that numerals appearing in the parentheses denote corresponding elements illustrated in an embodiment shown in the drawings and to be described later.

With this communication equipment, the AM band wave signal from the upper, first element (1) is synthesized with the radio wave signal from the lower, second element (2) by the filter (5) and the synthesizing means (13, 14) to be transferred to the AM/FM band receiver (9), thus enhancing the reception sensitivity of AM band radio wave by the AM/FM band receiver (9). Where an AM wave receiver adapted for use with a devoted AM band reception antenna is used, an amplifier which has been added to such receiver in the prior art practice can be eliminated or may have a low gain.

Other objects and features of the invention will become apparent from the following description of an embodiment thereof with reference to the drawings.

DESCRIPTION OF PREFERRED EMBODIMENT

Figure 1:
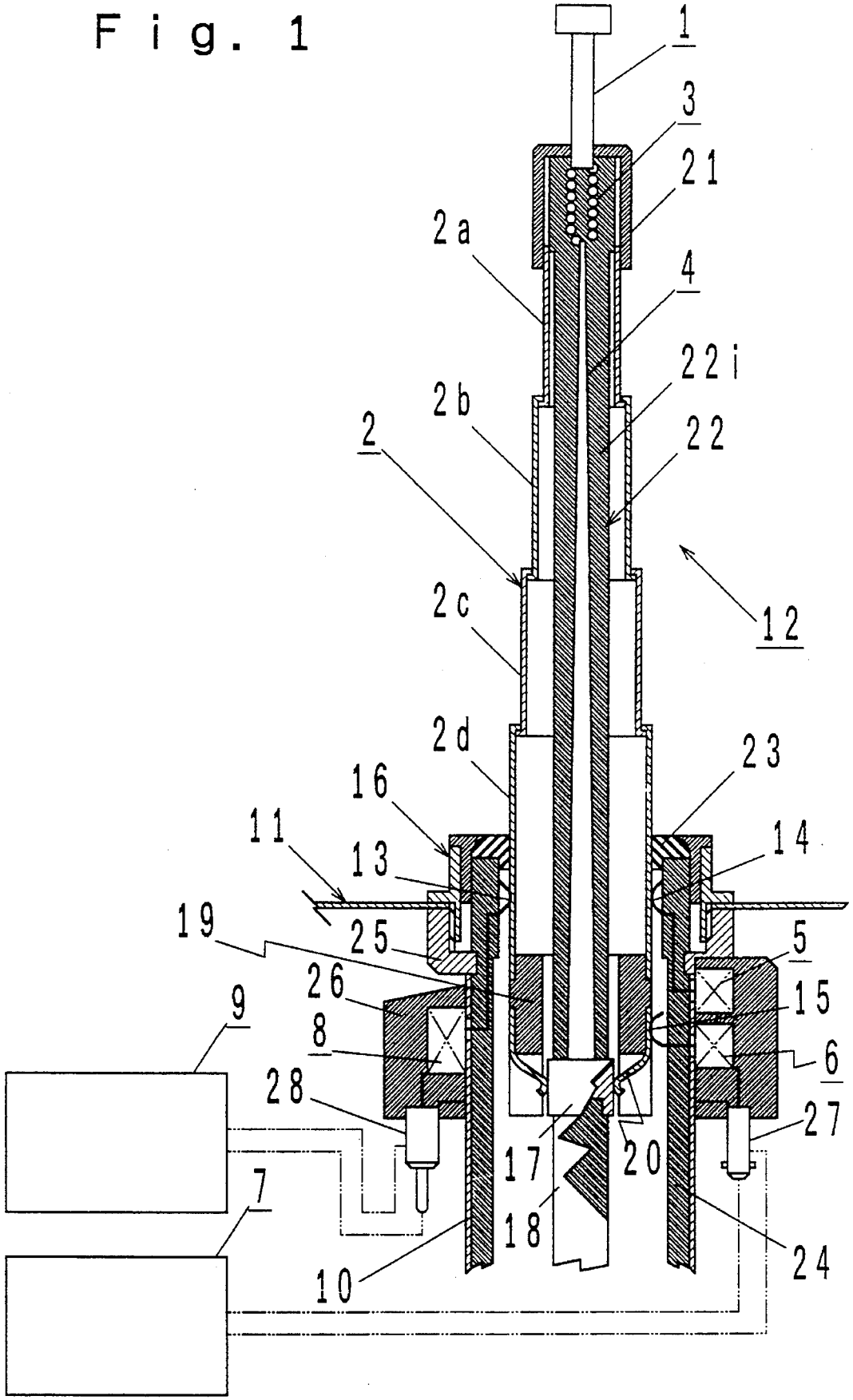
FIG. 1 is a schematic view of an embodiment of the invention, illustrating a 3 band antenna in longitudinal section.

Referring to FIG. 1, a first element 1 For reception and transmission of a radio wave in the UHF band slidably extends through a cap 21 and is secured to an insulator **22*i* of a feeder cable 22 by a locking structure, not shown. A matching coil 3 is loaded in the insulator 22*i* and has its one end connected to the first element 1 while the other end is connected to a feeder rod 4 of the cable 22. A feeder base 17 is secured to the lower end of the cable 22, to which the feeder rod 4 is electrically connected. A second element 2 for reception of FM band waves comprises a telescopic assembly of divided sleeves 2*a*, 2*b*, 2*c* and 2*d* of increasing diameters which are fitted inside the adjacent sleeves in a telescopic manner. One end of the sleeve 2*a* is fixedly connected with the cap 21 and the lower end of the sleeve 2*d* is fixedly connected to a cylindrical insulator base 19, through which the feeder cable 22** extends.

A connecting rod 18 which is electrically insulating and flexible is secured to the feeder base 17. While not shown, the rod 18 is bent into a U-configuration, with a vertical drive mechanism being coupled to the bend. By driving the rod 18 upwardly, the feeder cable 22 can be displaced to the upper position shown in FIG. 1. By driving the rod 18 downwardly when it occupies such upper position, the feeder cable 22 is lowered. The descending movement of tile cable 22 takes place by initially sliding the first element 1 down with respect to the cap 21 until its top head bears against tile cap 21, whereupon the cap 21 and the first sleeve **2*a* are driven downward together with the first element 1 by a sliding movement with respect to the second sleeve 2*b* until the lower end surface of the cap 21 bears against the top of the second sleeve 2*b*, whereupon the second sleeve 2*b* is driven downward together with the first element 1, the cap 21 and the first sleeve 2*a* by a sliding movement with respect to the third sleeve 2*c*. In this manner, the first element 1 and the cap 21 move down while accompanying a shrinkage of the second element 2. When the second element 2 shrinks to its limit, the fourth sleeve 2*d* moves down until the top of the sleeve 2*d* moves down close to the upper end face of a rubber bushing 23** in the form of an O-ring, which represents the limit of downward movement and where the telescopic shrinkage ends.

A contact assembly 20 is secured to the insulator base 19 and comprises a ring body secured to the base 19, and a plurality of leaves which extend from the body toward the center of the base 19. As shown in FIG. 1, when the feeder cable 22 is in its upper position, the leaves are engaged by the feeder base 17.

The insulator base 19 is located inside a pole 24 of an insulator. A bracket 25 and a metal enclosure 10 are fixedly mounted on the pole 24. The rubber bushing 23 in the form of an O-ring is filled around the upper end face of the pole 24, which is then inserted through an opening formed in a metal roof 11 of an automobile. A bracket 16 is fitted around the opening, and is then screwed into the bracket 25, whereby the bracket 25 can be fixedly mounted on the roof 11 of the automobile. It will be appreciated that the metal enclosure 10 is electrically connected to the automobile roof 11 through the bracket 25. A terminal base 26 having a low pass filter 5, a high pass filter 6 and a low pass filter 8 embedded therein is fixedly mounted around the enclosure 10.

The low pass filter 5 has an input end connected to a contacting reed 15 which is disposed in sliding contact with the contact assembly 20 and an output end connected to a contacting reed 14 which is disposed in sliding contact with the fourth sleeve **2*d* of the second element 2, with a ground terminal of the filter being connected to the metal enclosure 10**.

The high pass filter 6 includes an input terminal connected to the contacting reed 15 disposed in sliding contact with the contact assembly 20, and an output terminal connected to the input; of a mobile UHF automobile telephone 7 through a terminal member 27, with a ground terminal of the filter 6 being connected to the metal enclosure 10. The ground terminal of the mobile telephone 7 is also connected to the metal enclosure 10 through the terminal member 27.

The low pass filter 8 includes an input terminal connected to a contacting reed 13 which is disposed in sliding contact with the fourth sleeve **2*d* of the second element 2 and an output terminal connected to the input of a radio tuner 9 which is adapted to receive broadcasting radio waves in the AM and FM bands through a terminal member 28, with a ground terminal of the filter 8 being connected to the metal enclosure 10. The radio tuner includes a ground terminal which is also connected to the metal enclosure through the terminal member 28**.

Figure 2:
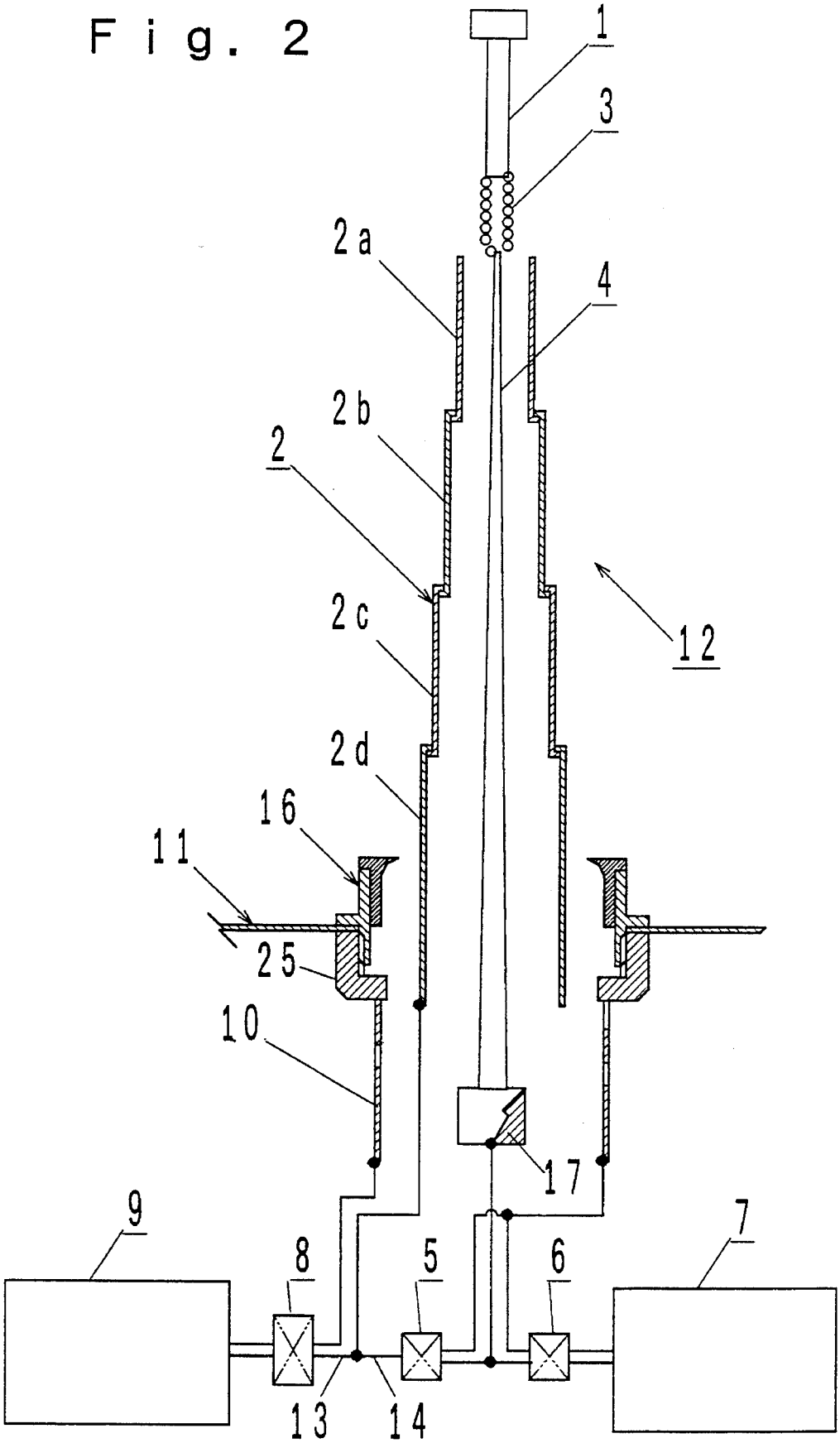
FIG. 2 is a circuit diagram, showing an interconnection between the 3 band antenna and filters 5, 6 and 8 shown in FIG. 1.

FIG. 2 shows an electrical circuit formed by the mechanical connections or contacts mentioned above. Considering a signal in the UHF band, it will be seen that a capacitive coupling between the second element 2 on one hand and the metal enclosure 10, brackets and roof 11 on the other hand places the second element 2 substantially at the same potential as the metal enclosure 10, whereby the second element 2, the metal enclosure 10, the insulator **22*i* (FIG. 1) and the feeder rod 4 constitute together a coaxial cable 12 which connects the first element 1 and the high pass filter 6 together. An impedance presented by the first element 1 and the matching coil 3 is equal to the characteristic impedance of the coaxial cable 12, thereby allowing an efficient transmission of a radio wave signal between the first element 1 and the mobile telephone 7**.

The First element 1 has a length which is equal to one-half the wavelength $\lambda_u$ of the radio wave (in the UHF band) received by and transmitted by the mobile telephone 7. The second element 2 has a length which is substantially equal to one-quarter the FM reception wavelength $\lambda_f$. The mobile telephone 7 is connected the feeder rod 4 which is in turn connected to the first element 1 through the contacting reed 15 and the high pass filter 6, the latter transmitting a signal of frequencies in the UHF band. The low pass filter 5 is also connected to the feeder rod 4 through the contacting reed 15. The low pass filter 5 transmits the radio wave signal in the AM band which is received by the first element to the contacting reed 13 through the contacting reed 14 and the second element 2. In other words, there appears on the contacting reed 13 an electrical signal which represents a synthesis of electrical signals corresponding to the radio wave in the AM band received by the first element 1 and the radio wave received by the second element 2. The low pass filter 8 is effective to derive a radio wave in either AM or FM band from the synthesized signal appearing on the contacting reed 13 for transmission to the radio tuner 9. The tuner 9 is adapted to cooperate with a radio receiver for AM and FM bands. Since the AM radio wave signal from the first element 1 which is used for reception and transmission of a radio wave in the UHF band is transmitted through the filter 5, contacting reed 14, second element 2, contacting reed 13 and low pass filter 8 to the tuner 9 associated with the AM/FM receiver, the signal level applied to the tuner 9 is high, increasing its reception sensitivity. Where an AM receiver (9) adapted to be used with a devoted AM band reception antenna is used only a low gain is required of an amplifier which midst be added to the receiver or such amplifier may be eliminated.

While a preferred embodiment has been shown and described, it should be understood that a number of changes and modifications are possible therein such as replacing the mobile telephone 7 by a personal radio communication equipment which utilizes a UHF band wave, replacing the low pass filter 5 by a band pass filter or band E filter which passes signals in the frequencies of the AM band. Accordingly, it is to be understood that there is no intention to limit the invention to the precise construction disclosed herein, and the right is reserved to all changes and modifications coming within the scope of the invention as defined in the appended claims.

What is claimed is:

1. A three band communication equipment comprising:

a three band antenna including an upper, first element for reception and transmission of radio waves in a UHF automobile telephone band and a lower, tubular, second element for reception of radio waves in a FM broadcast band, said first element being connected to a feeder rod through an impedance matching coil with the feeder rod disposed in a coaxial manner within the tubular second element and with the first element extending above an upper end of said second element;

an insulator which covers said feeder rod and said impedance matching coil and insulates said first element from said second element;

a UHF band receiver/transmitter connected to the first element;

an AM broadcast band filter connected to the first element through said feeder rod and said coil for deriving a signal corresponding to radio waves in said AM broadcast band received by the first element;

means for synthesizing said AM broadcast band radio wave signal derived by the AM broadcast band filter with a signal corresponding to a radio wave received by the second element; and an AM/FM broadcast band receiver connected to the synthesizing means.

2. A three band communication equipment comprising:

a three band antenna including an upper, first element for reception and transmission of radio waves in a UHF automobile telephone band and a lower, tubular, second element for reception of radio waves in a FM broadcast band, said first element being connected to a feeder rod through an impedance matching coil with the feeder rod disposed in a coaxial manner within the tubular second element and with the first element extending above an upper end of said second element;

an insulator which covers said feeder rod and said impedance matching coil and insulates said first element from said second element;

a UHF band receiver/transmitter connected to the first element;

an AM broadcast band filter connected to the first element through said feeder rod and said coil for deriving a signal corresponding to radio waves in said AM broadcast band received by the first element;

means for synthesizing said AM broadcast band radio wave signal derived by the AM broadcast band filter with a signal corresponding to a radio wave received by the second element; and an AM/FM broadcast band receiver connected to the synthesizing means, wherein said second element is comprised of a tubular telescopic assembly of interfitted divided sleeves each of which increases in diameter from said upper end of said second element toward a lower end and wherein said feeder rod is tapered with increasing diameters from said coil toward an opposite lower end.

3. A three band communication equipment comprising:

a three band antenna including an upper, first element for reception and transmission of radio waves in a UHF automobile telephone band and a lower, tubular, second element for reception of radio waves in a FM broadcast band, said first element being connected to a feeder rod through an impedance matching coil with the feeder rod disposed in a coaxial manner within the tubular second element and with the first element extending above an upper end of said second element;

an insulator which covers said feeder rod and said impedance matching coil and insulates said first element from said second element;

a UHF band receiver/transmitter;

a UHF band filter connected to the first element through said feeder rod and said coil for deriving a signal corresponding to a radio wave in a UHF automobile telephone band for application to the UHF receiver/transmitter;

an AM broadcast band filter connected to the first element through said feeder rod and said coil for deriving a signal corresponding to the radio waves in said AM broadcast band received by the first element;

means for synthesizing a signal corresponding to a radio wave in said AM broadcast band derived by said AM broadcast band filter with a signal corresponding to a radio wave received by the second element;

an AM/FM broadcast band receiver; and an AM/FM broadcast band filter for deriving a signal corresponding to a radio wave in either AM or FM broadcast band from a wave signal from the synthesizing means for application to the AM/FM receiver.

4. A three band communication equipment comprising:

a three band antenna including an upper, first element for reception and transmission of radio waves in a UHF automobile telephone band and a lower, tubular, second element for reception of radio waves in a FM broadcast band, said first element being connected to a feeder rod through an impedance matching coil with the feeder rod disposed in a coaxial manner within the tubular second element and with the first element extending above an upper end of said second element;

an insulator which covers said feeder rod and said impedance matching coil and insulates said first element from said second element;

a UHF band receiver/transmitter;

a UHF band filter connected to the first element through said feeder rod and said coil for deriving a signal corresponding to a radio wave in a UHF automobile telephone band for application to the UHF receiver/transmitter;

an AM broadcast band filter connected to the first element through said feeder rod and said coil for deriving a signal corresponding to the radio waves in said AM broadcast band received by the first element;

means for synthesizing a signal corresponding to a radio wave in said AM broadcast band derived by said AM broadcast band filter with a signal corresponding to a radio wave received by the second element;

an AM/FM broadcast band receiver; and an AM/FM broadcast band filter for deriving a signal corresponding to a radio wave in either AM or FM broadcast band from a wave signal from the synthesizing means for application to the AM/FM receiver, wherein said second element is comprised of a tubular telescopic assembly of interfitted divided sleeves each of which increases in diameter from said upper end of said second element toward a lower end and wherein said feeder rod is tapered with increasing diameters from said coil toward an opposite lower end.

5. A three band communication equipment as set forth in claim 3, wherein the synthesizing means is comprised of electrical interconnection elements for providing an interconnection between the output terminal of the AM filter, the lower, second element, and between the input terminal of the AM/FM broadcast band filter and the lower second element.

* * * * *